US006003242A

United States Patent [19]

Carley et al.

[11] Patent Number: 6,003,242

[45] Date of Patent: Dec. 21, 1999

[54] PORTABLE HEATER

[76] Inventors: Joseph C. Carley, 73 NE. 100 Rd., Clinton, Mo. 64735; Sean M. Carriere, 25587 Tee Dr., Caldwell, Id. 83605; Michael P. Conti, 215 McGoodwin St. #10, Warrensburg, Mo. 64093; James D. Termeer, 637 West Addison #3E, Chicago, Ill. 60613

[21] Appl. No.: 09/004,787

[22] Filed: Jan. 9, 1998

[51] Int. Cl.[6] ..... F26B 19/00

[52] U.S. Cl. ..... 34/202; 392/380

[58] Field of Search ..... 237/77; 34/202; 392/380

[56] References Cited

U.S. PATENT DOCUMENTS

| | | | |
|---|---|---|---|
| D. 119,197 | 2/1940 | MacFadden et al. . | |
| D. 144,637 | 5/1946 | Smith | D81/10 |
| D. 157,834 | 3/1950 | Bourner | D81/19 |
| D. 161,145 | 12/1950 | Wilson | D81/19 |
| D. 161,146 | 12/1950 | Wilson | D81/19 |
| D. 161,147 | 12/1950 | Wilson | D81/19 |
| D. 173,550 | 11/1954 | Wrablica, Jr. | D62/4 |
| D. 265,122 | 6/1982 | Townsend et al. | D23/122 |
| D. 267,424 | 12/1982 | Boldt et al. | D23/122 |
| D. 282,869 | 3/1986 | Parnell | D23/73 |
| D. 286,428 | 10/1986 | Liu | D23/122 |
| D. 290,498 | 6/1987 | Beane et al. | D23/122 |
| D. 290,997 | 7/1987 | Utsuki et al. | D23/155 |
| D. 291,350 | 8/1987 | Sherman et al. | D23/122 |
| D. 294,633 | 3/1988 | McBratney | D23/333 |
| D. 300,353 | 3/1989 | Yurkovic | D23/337 |
| D. 300,847 | 4/1989 | Lin | D23/335 |
| D. 301,277 | 5/1989 | Fu | D23/342 |
| D. 305,260 | 12/1989 | Mito | D23/337 |
| D. 306,342 | 2/1990 | Lane | D23/332 |
| D. 306,757 | 3/1990 | Lane | D23/335 |
| D. 309,182 | 7/1990 | Hsu | D23/382 |
| D. 311,951 | 11/1990 | Dubin | D23/335 |
| D. 312,124 | 11/1990 | Coup et al. | D23/382 |
| D. 313,069 | 12/1990 | McCormick | D23/335 |
| D. 314,613 | 2/1991 | De'Longhi | D23/330 |
| D. 315,598 | 3/1991 | Yamamoto et al. | D23/378 |
| D. 318,526 | 7/1991 | Chaney | D23/382 |
| D. 320,648 | 10/1991 | Velazquez | D23/335 |
| D. 323,708 | 2/1992 | Wang | D23/382 |
| D. 324,907 | 3/1992 | Cook | D23/328 |
| D. 325,251 | 4/1992 | Schindler et al. | D23/328 |
| D. 329,284 | 9/1992 | Patton | D23/378 |
| D. 337,635 | 7/1993 | Schindler et al. | D23/328 |

(List continued on next page.)

FOREIGN PATENT DOCUMENTS 61-208455 9/1986 Japan .

OTHER PUBLICATIONS

McMaster–Carr Catalog, USA, 1994.

Grainger Catalog, USA, 1996.

Holmes Catalog, USA, 1995/1997.

Duracraft Catalog, USA, 1993/1996/1997.

Marvin Catalog, USA, (publication date believed to be before Jan. 9, 1998).

Lakewood Catalog, USA, (publication date believed to be before Jan. 9, 1998).

DeLonghi Catalog, USA, (publication date believed to be before Jan. 9, 1998).

Heat Stream Catalog, USA, (publication date believed to be before Jan. 9, 1998).

Honeywell Catalog, USA, 1997.

*Primary Examiner*—Henry Bennett
*Assistant Examiner*—Derek S. Boles
*Attorney, Agent, or Firm*—Brinks Hofer Gilson & Lione

[57] ABSTRACT

A portable heater of the type having a housing containing an internal fan and heating element to force heated air out of a blower opening is disclosed herein. The heater housing includes a plurality of foot-operable, push-button switches mounted on an outlet face, and the housing is of a horizontally stable configuration. A fulcrum, which also may be utilized as a carrying handle, is also disclosed to assist in foot-operation of the switches, and an angled outlet face is disclosed to direct heated air from the housing.

8 Claims, 6 Drawing Sheets

U.S. PATENT DOCUMENTS

| | | | |
|---|---|---|---|
| D. 340,765 | 10/1993 | Joss et al. | D23/336 |
| D. 341,878 | 11/1993 | Cich, Jr. | D23/335 |
| D. 353,661 | 12/1994 | Cich, Jr. et al. | D23/335 |
| D. 353,662 | 12/1994 | Patton et al. | D23/335 |
| D. 354,557 | 1/1995 | Cich, Jr. et al. | D23/330 |
| 889,689 | 6/1908 | Jones | 34/60 |
| 1,190,572 | 7/1916 | Miller | 34/66 |
| 1,221,596 | 4/1917 | Riley | 34/66 |
| 1,457,873 | 6/1923 | Brown . | |
| 2,100,439 | 11/1937 | Friedman | 230/117 |
| 2,450,921 | 10/1948 | Smith | 219/38 |
| 2,537,330 | 1/1951 | Carroll | 219/39 |
| 2,574,949 | 11/1951 | Behman et al. | 219/39 |
| 2,813,673 | 11/1957 | Smith | 230/256 |
| 2,870,319 | 1/1959 | Ford | 219/39 |
| 2,875,316 | 2/1959 | Ford et al. | 219/39 |
| 3,001,056 | 9/1961 | Spear | 219/39 |
| 3,028,475 | 4/1962 | Nash | 219/39 |
| 3,059,090 | 10/1962 | Waters | 219/39 |
| 3,068,341 | 12/1962 | Ortiz et al. | 219/39 |
| 3,309,502 | 3/1967 | Witherspoon, Jr. | 219/369 |
| 3,320,406 | 5/1967 | Wainwright | 219/370 |
| 3,701,895 | 10/1972 | Sweetser | 240/9 |
| 3,725,640 | 4/1973 | Kunz | 219/370 |
| 3,731,057 | 5/1973 | Kunz et al. | 219/363 |
| 3,768,549 | 10/1973 | Goodie | 165/55 |
| 3,786,233 | 1/1974 | Bumpus et al. | 219/343 |
| 3,909,589 | 9/1975 | Stone et al. | 219/361 |
| 3,958,100 | 5/1976 | Stone | 219/361 |
| 4,384,189 | 5/1983 | Dahan | 219/364 |
| 4,406,216 | 9/1983 | Hott et al. | 98/116 |
| 4,453,202 | 6/1984 | Morris et al. | 362/147 |
| 4,681,024 | 7/1987 | Ivey | 98/34.6 |
| 4,694,142 | 9/1987 | Glucksman | 219/371 |
| 4,703,152 | 10/1987 | Shih-Chin | 219/370 |
| 4,707,933 | 11/1987 | Keck et al. | 34/97 |
| 4,740,670 | 4/1988 | You | 219/370 |
| 4,748,900 | 6/1988 | Swin, Sr. et al. | 98/40.09 |
| 4,760,243 | 7/1988 | Tedioli | 219/366 |
| 4,794,227 | 12/1988 | Antoniazzi et al. | 219/375 |
| 4,850,804 | 7/1989 | Huang | 416/246 |
| 4,870,253 | 9/1989 | De'Longhi | 219/369 |
| 4,873,422 | 10/1989 | Streich et al. | 219/370 |
| 4,888,469 | 12/1989 | Hennuy et al. | 219/370 |
| 5,007,103 | 4/1991 | Tyrrell et al. | 219/363 |
| 5,007,182 | 4/1991 | Fishman et al. | 34/90 |
| 5,021,932 | 6/1991 | Ivey | 362/96 |
| 5,197,111 | 3/1993 | Mills, II et al. | 392/347 |
| 5,245,692 | 9/1993 | Kawai | 392/367 |
| 5,280,679 | 1/1994 | Edelman | 34/66 |
| 5,438,764 | 8/1995 | Reppas et al. | 34/343 |
| 5,454,060 | 9/1995 | McDermott | 392/383 |
| 5,491,908 | 2/1996 | Ruiz et al. | 34/202 |
| 5,513,296 | 4/1996 | Goldstein | 392/367 |
| 5,613,304 | 3/1997 | Lin | 34/90 |
| 5,617,646 | 4/1997 | Viscuso | 34/60 |
| 5,655,055 | 8/1997 | Goldstein | 392/367 |

40, 45, 50
35
27
22
A
19
B
88
1, 2
20
5
30c
10c
17
88
18
25c
75

10b
25b
88
88
10c
10a
14
70
65
10d
18
88
88
15
27

PORTABLE HEATER

BACKGROUND OF THE INVENTION

The present invention relates generally to heaters. In particular, the invention relates to blower-type heaters which are portable and compact. Smaller blower-type, portable electric convection heaters for use in the home or office have become readily available in recent years, replacing bulkier, radiator-type heaters. Blower-type heaters are typically placed on the floor at a distance from the user to allow heated air to be blown horizontally or at an angle close to horizontal. While such heaters are usually adequate for heating a small-sized room, these units typically have shortcomings. For example, heated air being blown from the unit will often be uncomfortably warm for users whose feet are on the floor close to the unit's outlet. Furthermore, due to the floor location of the heater and its controls, the user will be required to bend down to adjust the controls.

In addition, such a heater is typically proportioned in a horizontally unstable configuration, in that the heater can be easily knocked over onto one of its sides, either creating a hazardous condition or causing the heater to shut off. The uneven weight distribution can also make the heater awkward to lift or reposition.

It is therefore an object of the present invention to provide a portable heater that allows for comfortable foot operation of the heater controls. It is another object of the present invention to provide a portable heater housing that functions partially as a footrest.

It is yet another object of the present invention to provide a portable heater having a housing that is horizontally stable.

It is still another object of the present invention to provide a portable heater that dispenses heated air in a generally vertical direction.

It is still another object of the present invention to provide a portable heater that efficiently circulates air externally and internally of the housing.

SUMMARY OF THE INVENTION

The present invention provides a portable heater that is horizontally stable and allows for efficient and convenient operation by the user. In particular, a portable heater is provided which includes a plurality of foot-operable, push-button switches mounted on a cover face portion of the housing.

In another aspect of the invention, ergonomically-improved button controls are provided on the heater housing to facilitate foot control of the unit.

In yet another aspect of the present invention, the housing defines a fulcrum upstanding from a lower portion of the housing. The fulcrum facilitates foot-operation of the switches by allowing a portion of a foot to rest on the fulcrum during operation of the switch and also may be utilized as a carrying handle.

In yet another aspect of the present invention, a heater is provided that includes a housing having a heat outlet face and a blower opening defined in the heat outlet face, a base positioned substantially opposite the heat outlet face, a plurality of sidewalls upstanding from the base, and intake portions within the sidewalls. The blower opening is generally positioned at an angle greater than approximately 135 degrees from a horizontal plane through the base.

In still another aspect of the present invention, the heater is provided with a horizontally stable configuration wherein the area defined within the perimeter of the base is greater than the area defined within the perimeter of any one of the sidewalls.

In still another aspect of the present invention, the heater includes a pedestal centrally located on and upstanding from the base within the housing. A fan motor, fan blade and heating element are mounted to the pedestal.

These and other features and advantages of the invention will become apparent upon the review of the following detailed description of the presently preferred embodiments of the invention, taken into conjunction with the appended figures.

DETAILED DESCRIPTION OF THE PRESENTLY PREFERRED EMBODIMENTS

Figure 1:
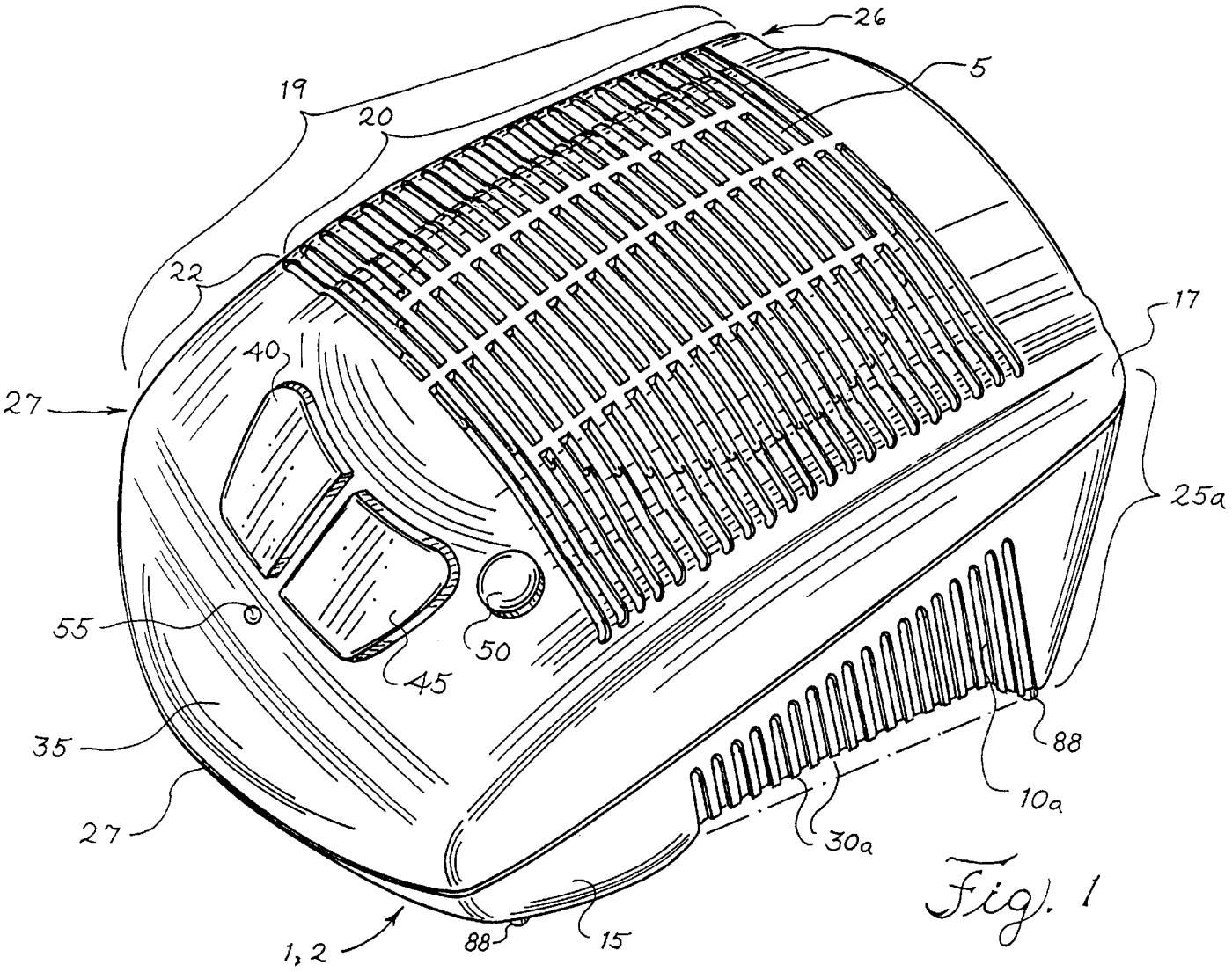
FIG. 1 is a left side perspective view of a heater constructed according to a preferred embodiment of the present invention.
Figure 2:
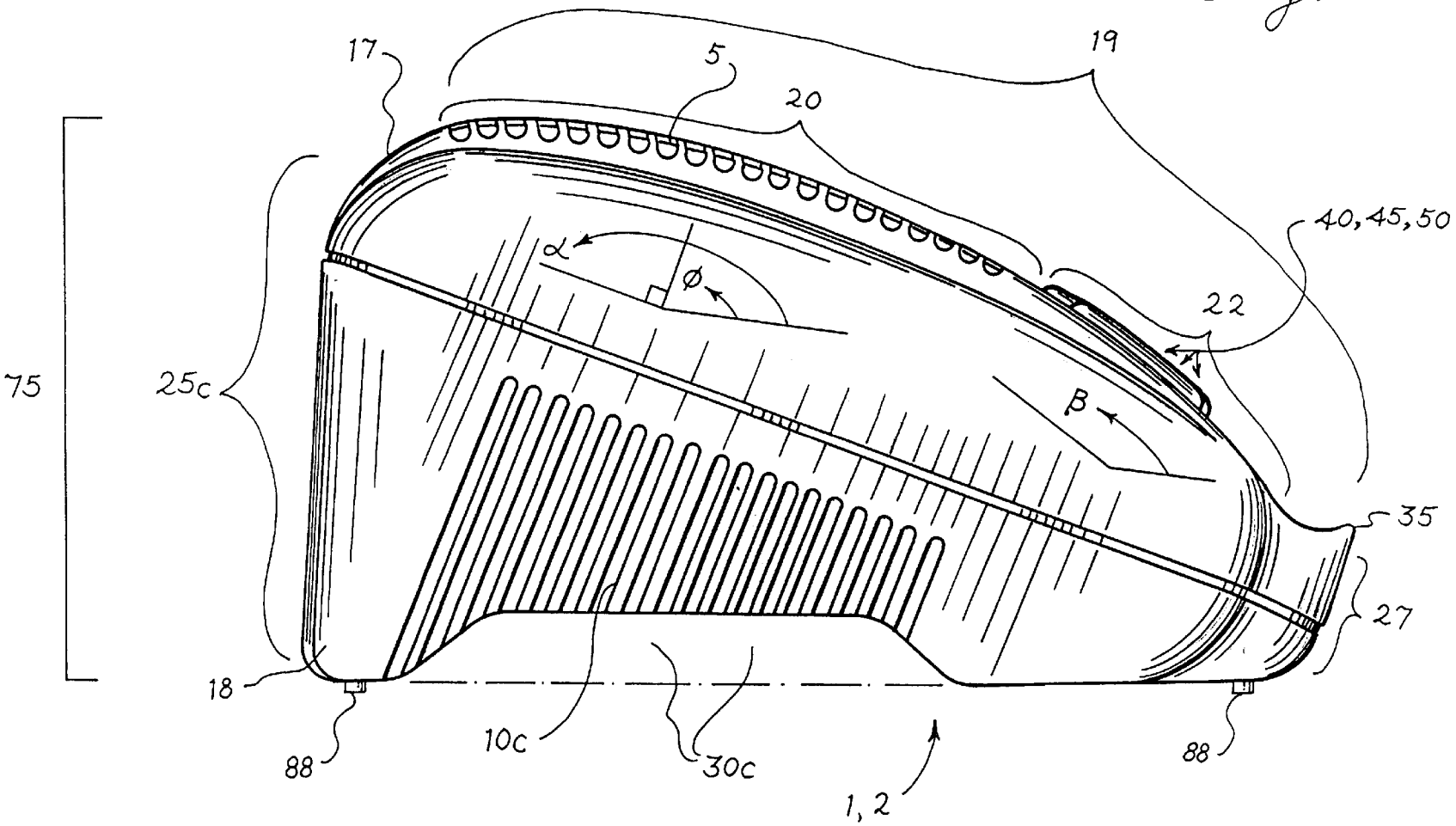
FIG. 2 is a right side elevational view of the heater shown in FIG. 1.
Figure 4:
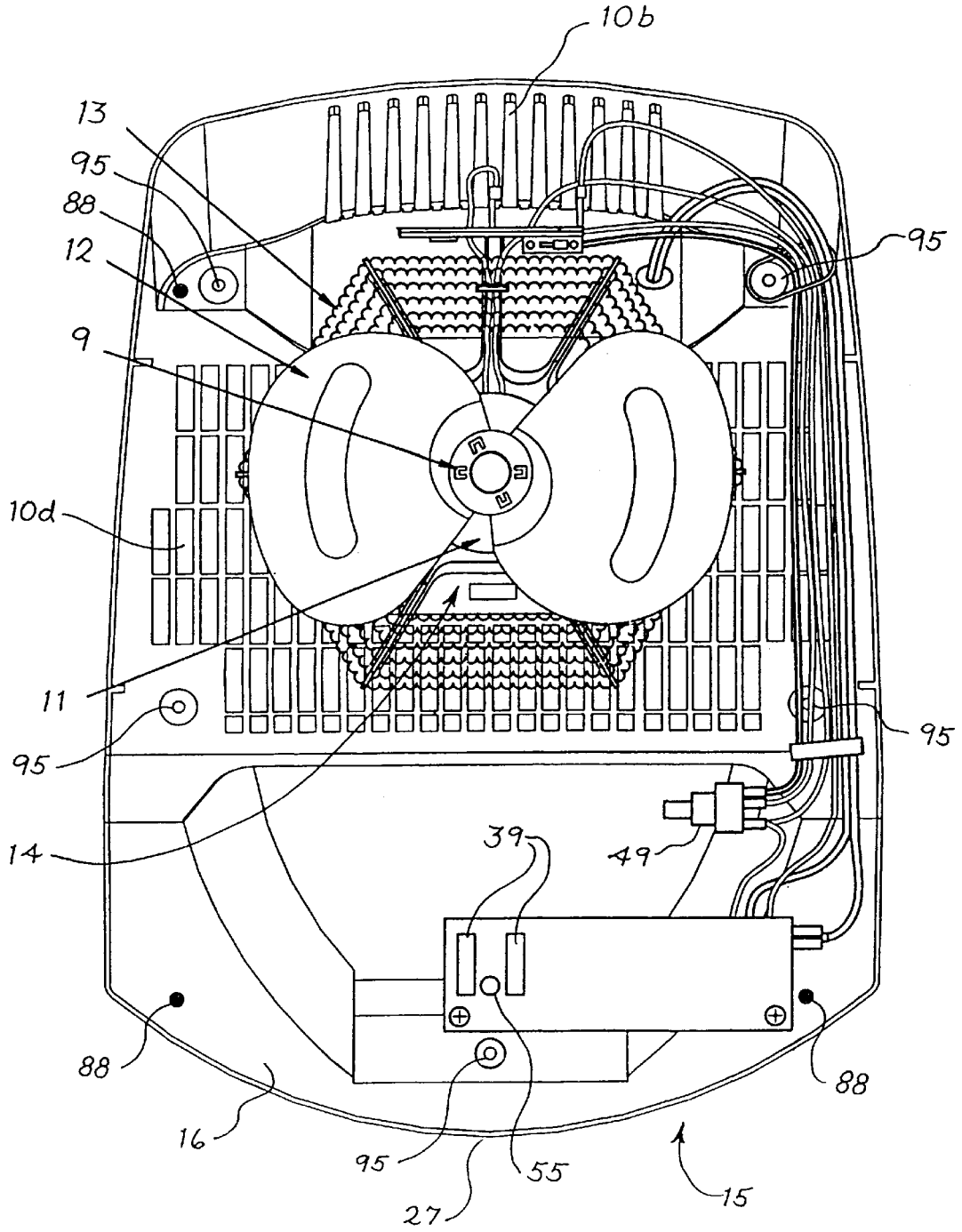
FIG. 4 is a top perspective view of the heater shown in FIG. 1, with the cover removed.
Figure 5:
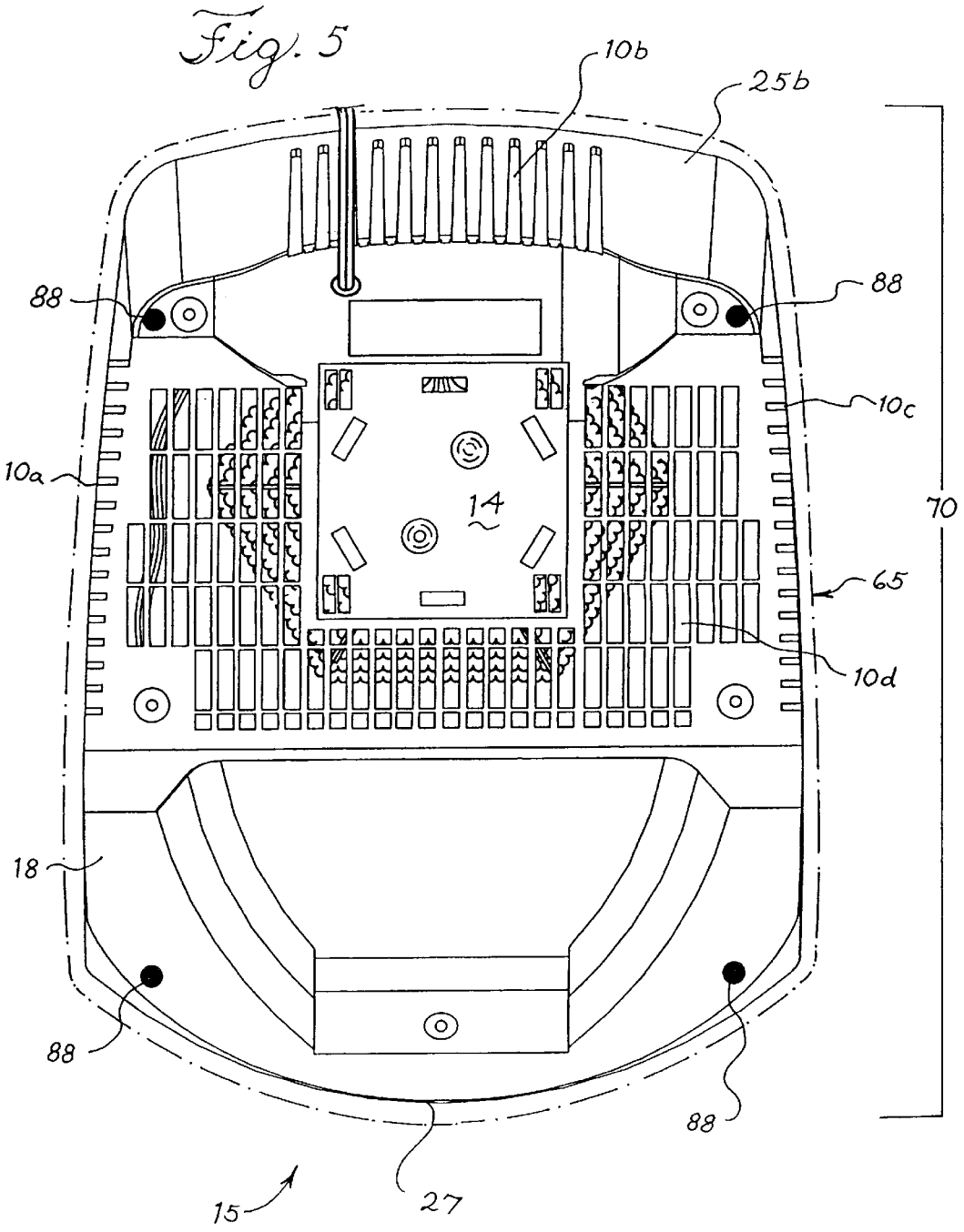
FIG. 5 is a bottom perspective view of the heater shown in FIG. 1.
Figure 6:
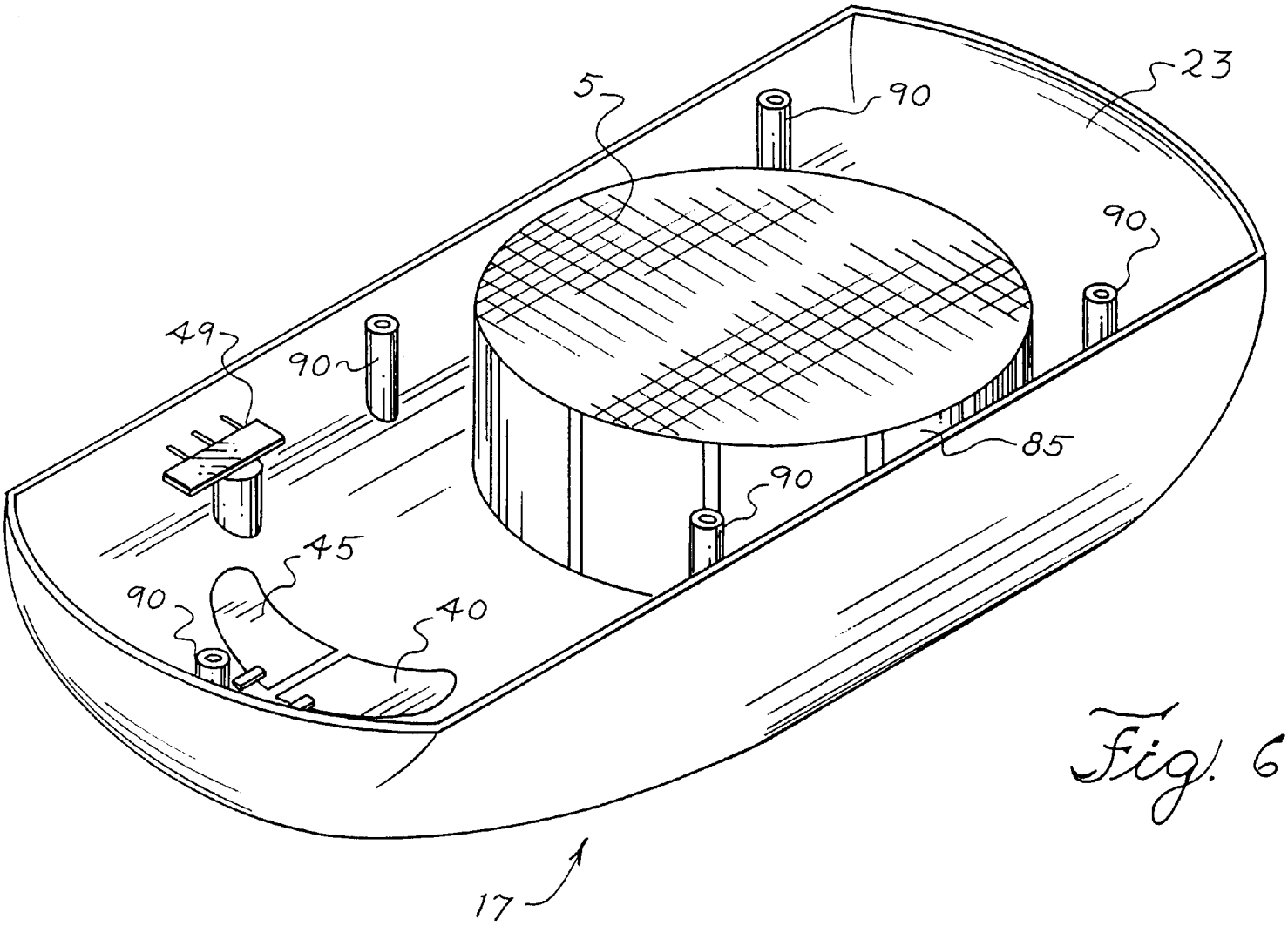
FIG. 6 is a right side perspective view of the cover bottom of the heater shown in FIG. 1.

Referring now to the drawings, a heater 1 is shown including a housing 2, as seen in FIGS. 1 and 2. The housing 2 is preferably comprised of a two-piece structure, a cover 17 and a base 15, which join to form three sidewalls 25 and a front portion 27. FIGS. 1 and 6 show that cover 17 preferably has a cover face 19 and a cover bottom 23. FIG. 1 shows that the cover face 19 includes a heat outlet face 20, which is located on an upper portion 26, and a button face 22, which is located on a lower portion 27. A circular fan guard 85 and five descending mountings 90 are located along the perimeter of the cover bottom 23, as seen in FIG. 6. Base 15 has a base face 16 and a base bottom 18, as seen in FIGS. 4 and 5. Five ascending mountings 95 are located along the perimeter of the base face 16, as seen in FIG. 4. Descending mountings 90 align with and are joinable to ascending mountings 95 with Phillips head screws.

FIG. 4 shows a preferred embodiment in which a fan hub 9, fan motor 11, fan blade 12, and heating element 13, are centrally mounted on a pedestal 14, forming a free-standing structure. The pedestal 14 is preferably upstanding from a base face 16. This configuration provides a base 15 that is symmetrically-balanced, allowing for easy lifting and repositioning of the heater 1 by the user. This central location also assists in providing a horizontally stable configuration, in that the heater cannot be easily knocked over onto one of its sidewalls 25*a*, 25*b*, or 25*c* since the heater's weight is centered on its base 15. The heating element 13 is preferably comprised of wire coils arranged in hexagonal shape, surrounding the fan motor 11. Fan hub 9 and fan blade 12 are located above heating element 13. As best seen in FIG. 1, this arrangement allows air below fan blade 12 to be heated and drawn through fan blade 12 and out through the blower opening 5, which is defined by heat outlet face 20.

Figure 3:
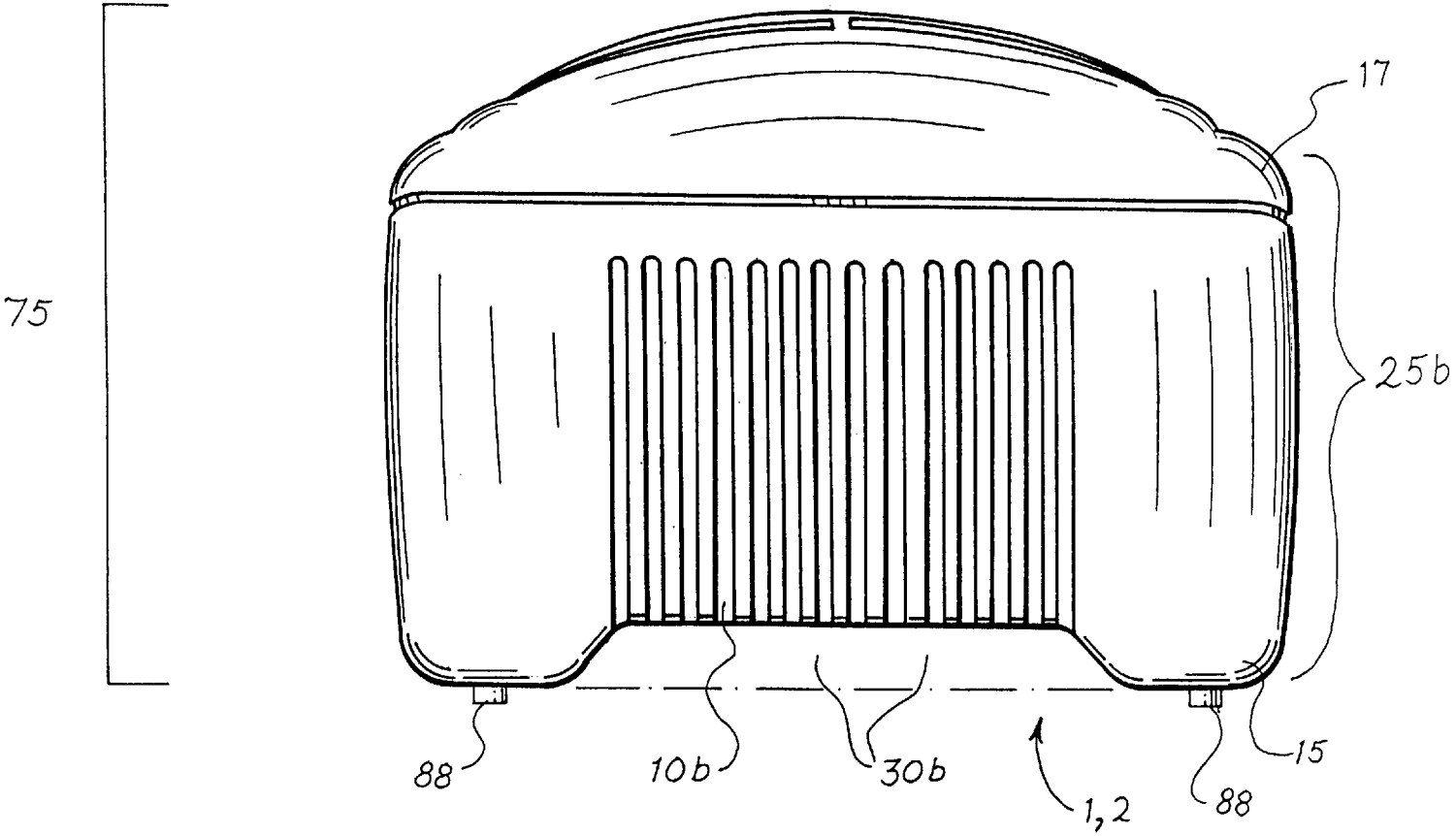
FIG. 3 is a rear view of the heater shown in FIG. 1.

As shown in FIG. 6, the fan guard 85 surrounds the fan hub 9, fan motor 11, fan blade 12, and heating element 13. The fan guard 85 is preferably located below the heat outlet face 20 to provide a guided airpath for heated air to travel through the blower opening 5. FIG. 5 illustrates that a base footprint portion 65 is defined by the perimeter of the base bottom 18. Preferably, the base footprint portion 65 has a length 70 greater than a maximum height 75 of the heater 1, as seen in FIGS. 2, 3, and 5. These proportions also promote a wider stance for the housing 2, thereby creating a more horizontally stable configuration.

FIGS. 1, 2, and 4, show that the three sidewalls 25*a*, 25*b*, and 25*c* preferably define intake portions 10*a*, 10*b*, and 10*c* and recessed areas 30*a*, 30*b*, and 30*c*. The recessed areas 30*a*, 30*b*, and 30*c* are located below their respective intake portions 10*a*, 10*b*, and 10*c*. The plane of intake portions 1*a*, 10*b*, and 10*c* on their respective sidewalls 25*a*, 25*b*, and 25*c* are preferably generally perpendicular to the plane of base 15. Preferably, the cover 17 joins the base 15 above the intake portions 10*a*, 10*b*, and 10*c* on their respective sidewalls 25*a*, 25*b*, and 25*c*. The base 15 also preferably defines a fourth intake portion 10*d* along a portion of the base bottom 18. The intake portions 10*a*, 10*b*, 10*c*, and 10*d* preferably have a grille structure that is aesthetically-pleasing yet permits a high volume of air to be drawn inside the housing 2. FIGS. 1, 2, 3, and 5 show that the base 15 defines four projecting corner members 88 that hold the base 15 in a slightly elevated manner above the floor, permitting the fourth intake portion 10*d* defined by the base bottom 18 to draw more air into the housing 2. Also, preferably, corner members 88 are composed of rubber to prevent skidding of the heater 1. Other horizontally stable configurations may exist, such as the use of extending members or a base plate supporting the heater 1.

Mounted on the housing 2 are a power switch 39, a temperature-selection switch 49, and a safety light 55, as seen in FIG. 4. The switches 39 and 49 are push-button switches of conventional construction. The power switch 39 is preferably operated by "on" button 40 and "off" button 45, both of which are hinged to cover 17, as seen in FIGS. 1 and 6. The temperature-selection switch 49 is operated by temperature button 50. Preferably, buttons 40, 45, and 50 have top surfaces large enough to be operated by a shoe-covered foot and are affixed to switches 39 and 49. The buttons 40, 45, and 50 are preferably located on the lower portion 27 to further facilitate foot-operation, as seen in FIG. 2. However, those skilled in the art would be able to place the buttons 40, 45 and 50 in various locations in keeping with the invention. FIG. 1 shows that the buttons 40 and 45 preferably are of trapezoidal shape and have an upper width greater than or equal to a bottom width, further facilitating foot-operation. The toe of a shoe-covered foot thus has greater margin of error in attempting to operate the buttons 40 and 45.

FIGS. 1 and 2 show that upstanding from front portion 27 and button face 22, is a curved fulcrum 35 to further facilitate foot-operation of buttons 40, 45, and 50. The operating foot can pivot on fulcrum 35, which provides leverage to assist in the operation of the various buttons. Preferably, the fulcrum 35 is positioned about 2.5 inches above the base bottom 18 and has a curved surface along both its length and width. The fulcrum 35 also functions as a handle, which can be easily used to reposition or carry the heater 1. In addition, the fulcrum 35 can serve as a heel rest wherein the heater 1 can be used as an ergonomically-designed foot rest.

FIG. 2 shows that while heat outlet face 20 and button face 22 are both somewhat curved, their secant planes are positioned at an angle to the plane of base 15, as shown in FIG. 2. The secant plane of heat outlet face 20 is preferably positioned at an angle $\alpha$ somewhat greater than 145 degrees to the plane of base 15. The secant plane of button face 22 is preferably positioned at an angle $\beta$ somewhat greater than 135 degrees to the plane of base 15. This arrangement permits the heater 1 to direct heated air upwardly from the floor at an angle $\Phi$ somewhat less than 90 degrees to the plane of base 15. The angle $\Phi$ is determined by the angle formed by the plane of base 15 and the line normal to the secant plane of heat outlet face 20. Note that the angles $\alpha$, $\beta$, and $\Phi$ are approximate and that the angles $\alpha$ and $\beta$ can also be defined relative to the horizontal.

Angle $\alpha$ is preferably greater than angle $\beta$ so that the secant plane of button face 22 is at a slightly steeper slant than the secant plane of heat outlet face 20, permitting a shoe-covered foot pivoting on fulcrum 35 to operate the buttons 40, 45, and 50. This arrangement also allows the heater 1 to be used as an ergonomically-designed footrest, with the fulcrum 35 serving as a heel rest. In the preferred embodiment, the angle preferences are $\alpha$=154°, $\beta$=144°, and $\Phi$=64°. Alternatively, the cover face 19 can be in the form of a continuous curve, including a steeper curve in the area of button face 22.

The heater 1 preferably has a power rating of 1000 watts and operates on conventional household electricity. The safety light 55 is linked in series to switch 39 and illuminates upon the closing of the switch 39. The connections and circuitry of the heater I are conventional and well-known to those skilled in the art.

Of course, it should be understood that a wide range of changes and modifications can be made to the embodiments described above. For example, other housing configurations may be provided to give horizontal stability to the heater, such as widely projecting leg members or a wide pedestal-type base. Furthermore, other switch or push-button configurations, such as a single power and temperature button, a large toggle or other controls may be implemented to allow the user more options for controlling the heater using the foot. It is therefore intended that the foregoing detailed description be regarded as illustrative rather than limiting and that it be understood that it is the following claims, including all equivalents, which are intended to define the scope of this invention.

We claim:

1. A heater comprising:

a housing, said housing having a base and a heat outlet face, said heat outlet face inclined at an angle between 90 and 180 degrees from a horizontal plane through said base; and a plurality of push-button switches mounted on said housing, said switches being foot-operable, said housing further defining a fulcrum upstanding from a lower portion of said housing, at least one of said switches being in close proximity to said fulcrum, and said fulcrum facilitating foot-operation of at least one of said switches by allowing a portion of a foot to rest on said fulcrum while contacting said switch.

2. The heater of claim 1, wherein said housing includes a base and a cover, wherein said fulcrum upstanding from said cover and said fulcrum is in close proximity to a horizontal plane through said base.

3. The heater of claim 2, wherein at least one of said switches includes at least one button face, said button face having a bottom width and an upper width, said upper width located further from said fulcrum than said bottom width, said upper width greater than said bottom width.

4. A heater comprising:

a housing having a heat outlet face, said heat outlet face defining a blower opening, said opening generally being positioned on a plane at a first angle greater than approximately 135 degrees from a horizontal plane through said base, said housing including a plurality of push-button switches mounted thereon, said switches being foot-operable, said housing further defining a fulcrum upstanding from a lower portion of said housing, at least one of said switches being in close proximity to said fulcrum, said housing including a base positioned substantially opposite said heat outlet face; and a plurality of sidewalls upstanding from said base, said sidewalls each defining an intake portion.

5. The heater of claim 4, wherein a button face is positioned substantially opposite said base at an angle to said horizontal plane less than said first angle.

6. The heater of claim 5, wherein said button face is positioned at an angle to said heat outlet face.

7. The heater of claim 4, wherein said housing defines an airpath between said intake portions and said blower opening.

8. A heater comprising:

a housing including a base having a base face, and said housing including a cover, said cover having a heat outlet face angled relative to said base face, said heat outlet face defining a blower opening;

a pedestal centrally located on and upstanding from said base within said housing;

a fan motor mounted on said pedestal;

a fan blade mounted on said fan motor, said fan blade generally being oriented to face said blower opening to blow heated air through said opening; and a heating element mounted over said pedestal below said fan blade.

* * * * *